US010333240B2

(12) United States Patent
Niitsu

(10) Patent No.: US 10,333,240 B2
(45) Date of Patent: Jun. 25, 2019

(54) CONNECTOR ASSEMBLY FOR ELECTRICALLY CONNECTING CIRCUIT BOARDS

(71) Applicant: Molex, LLC, Lisle, IL (US)

(72) Inventor: Toshihiro Niitsu, Machida (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/928,404

(22) Filed: Mar. 22, 2018

(65) Prior Publication Data

US 2018/0277975 A1 Sep. 27, 2018

(30) Foreign Application Priority Data

Mar. 27, 2017 (JP) ..... 2017-060862

(51) Int. Cl.

| | |
|---|---|
| ***H01R 13/40*** | (2006.01) |
| ***H01R 12/91*** | (2011.01) |
| ***H01R 12/70*** | (2011.01) |
| ***H01R 13/28*** | (2006.01) |
| ***H01R 13/20*** | (2006.01) |
| ***H01R 12/71*** | (2011.01) |
| *H01R 12/00* | (2006.01) |
| *H01R 31/06* | (2006.01) |

(52) U.S. Cl.

CPC ..... *H01R 12/91* (2013.01); *H01R 12/707* (2013.01); *H01R 12/718* (2013.01); *H01R 13/20* (2013.01); *H01R 13/28* (2013.01); *H01R 9/096* (2013.01); *H01R 31/06* (2013.01)

(58) Field of Classification Search

None

See application file for complete search history.

(56) References Cited

U.S. PATENT DOCUMENTS

| | | | | |
|---|---|---|---|---|
| 5,879,177 | A * | 3/1999 | Honma | H01R 13/6315 439/246 |
| 5,980,290 | A * | 11/1999 | Meynier | H01R 13/6315 439/246 |
| 6,497,579 | B1 * | 12/2002 | Garbini | H01R 13/6315 439/246 |
| 8,801,459 | B2 * | 8/2014 | Mrowka | H01R 24/54 439/246 |
| 9,484,688 | B2 * | 11/2016 | Hugel | H01R 24/542 |

FOREIGN PATENT DOCUMENTS

| | | |
|---|---|---|
| JP | H05-023452 U | 3/1993 |
| JP | 2013-114933 A | 6/2013 |

* cited by examiner

*Primary Examiner* — Tho D Ta

(74) *Attorney, Agent, or Firm* — Molex, LLC

(57) ABSTRACT

Connector assembly includes first connector, second connector opposing first connector, and relay conductor that is held by first conductor and second connector and allows conduction between conduct first connector and second connector, wherein first connector preferably includes a pair of terminals that clamp relay conductor such that movement of relay conductor in the X-axis direction, which is the relative moving direction with respect to second connector, is allowed, and wherein second connector preferably includes a pair of terminals that clamp relay conductor such that movement of relay conductor in the Y-axis direction, which is the relative moving direction with respect to first connector and intersects the X-axis direction, is allowed.

16 Claims, 6 Drawing Sheets

CONNECTOR ASSEMBLY FOR ELECTRICALLY CONNECTING CIRCUIT BOARDS

RELATED APPLICATIONS

This application claims priority to Japanese Application No. 2017-060862, filed Mar. 27, 2017, which is incorporated herein by reference in its entirety.

TECHNICAL FIELD

The present disclosure relates to a connector assembly.

BACKGROUND ART

A connector for electrically connecting circuit boards together is disclosed in the following Patent Document 1. The connector includes a plug contact soldered to a circuit board and a receptacle contact, and is configured such that the plug contact is fitted between a pair of contact pieces provided on the receptacle contact. In Patent Document 1, the plug contact is configured such that the plug contact is allowed to move in the direction (longitudinal direction) in which the pair of contact pieces is not provided while making contact with the pair of contact pieces. In addition, the plug contact has a cylindrical shape, configured so as to allow movement toward the rotational direction while making contact with the pair of contact pieces.

Patent Document 1: JP 2013-114933 A

SUMMARY

There is a need for further improvement of the allowable range for the displacement of a circuit board that is electrically connected via a connector.

One of the advantages of the present disclosure is that it proposes a connector assembly that allows positional displacement in multiple directions.

The connector assembly proposed by the present disclosure is a connector assembly including a first connector, a second connector opposing the first connector, and a relay conductor that is held by the first connector and the second connector and allows conduction between the first connector and the second connector; wherein the first connector preferably includes a pair of terminals that clamp the relay conductor so that movement of the relay conductor in a first direction, which is a relative moving direction with respect to the second connector, is allowed; and wherein the second connector preferably includes a pair of terminals that clamp the relay conductor so that movement of the relay conductor in a second direction, which is a relative moving direction with respect to the first connector and intersects the first direction, is allowed. This connector assembly can allow positional displacement of the circuit board, on which the connector assembly is attached, in the first direction and the second direction, and suppress a load from being placed on these circuit boards if positional displacement occurs.

In one embodiment of the present disclosure, the relay conductor preferably includes a first surface opposing the first connector, a second surface opposing the second connector, and a side surface for connecting the first surface and the second surface; wherein the pair of terminals of the first connector preferably includes holding parts that are supported by a base part and on which edges are respectively formed along the first direction extending through between the first surface and the second surface of the relay conductor, and the edges preferably conductively clamp the side surface of the relay conductor so as to conduct with the relay conductor; and wherein the pair of terminals of the second connector preferably includes holding parts that are supported by a base part and on which edges are respectively formed along the second direction extending through between the first surface and the second surface of the relay conductor, and the edges preferably conductively clamp the side surface of the relay conductor so as to conduct with the relay conductor.

In one embodiment of the present disclosure, each of the holding parts provided on the pair of terminals of the first connector preferably includes clamping pieces that extend to the other terminal, with the edge capable of being formed on this clamping piece; and each of the holding parts provided on the pair of terminals of the second connector preferably includes clamping pieces extending to the other terminal, with the edge capable of being formed on this clamping piece.

In one embodiment of the present disclosure, the relay conductor preferably includes a retaining part that protrudes from the side surface, the side surface that is nearer the second connector side than the retaining part of the relay conductor is preferably held on the holding parts of the first connector, and the side surface that is nearer the first connector side than the retaining part of the relay conductor is preferably held on the holding parts of the second connector.

In one embodiment of the present disclosure, a gap is preferably provided at least either between the first surface of the relay conductor and the base part of the first connector or between the second surface of the relay conductor and the base part of the second connector.

In one embodiment of the present disclosure, the retaining part preferably has inclined surfaces on which, when the first connector and the second connector are spaced apart from each other, they slide to the edge of the second connector following the side surface of the first connector, along with an abutting surface that protrudes from the side surface on the second connector side and on which the clamping piece of the first connector is locked.

In one embodiment of the present disclosure, a gap is preferably provided at least either between the first surface of the relay conductor and the base part of the first connector or between the second surface of the relay conductor and the base part of the second connector.

In one embodiment of the present disclosure, the relay conductor preferably has a disk shape and the region that is clamped between and makes contact with a pair of edges on the side surface preferably has a continuous, identical radius curved surface.

In one embodiment of the present disclosure, the holding parts of the first connector preferably include a pair of regulating parts for regulating the movable range of the relay conductor in the first direction.

In one embodiment of the present disclosure, the holding parts of the second connector preferably include a pair of regulating parts for regulating the movable range of the relay conductor in the second direction.

DETAILED DESCRIPTION OF THE PREFERRED EMBODIMENTS

Figure 1:
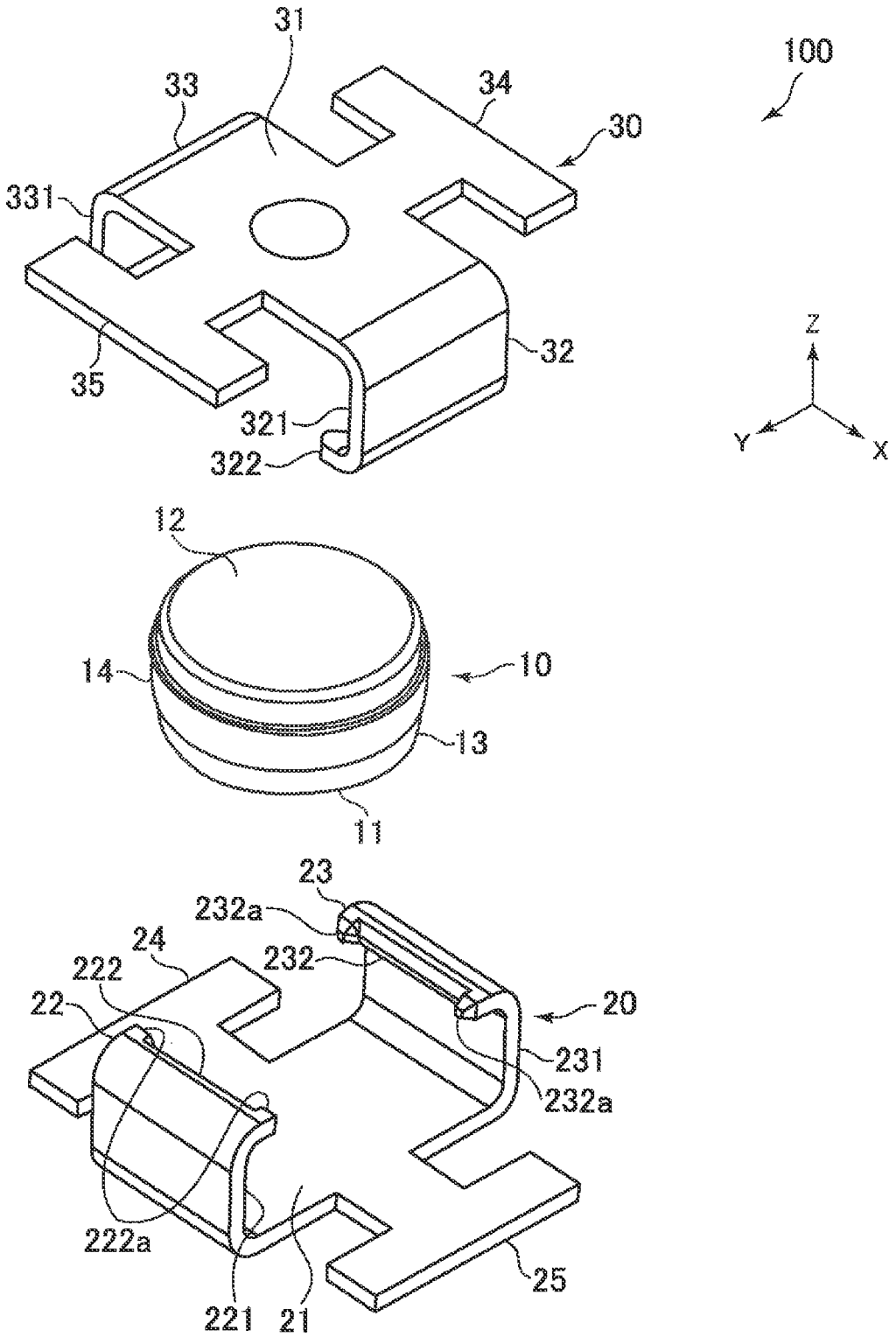
FIG. 1 is an exploded perspective view of a connector assembly according to the present embodiment.
Figure 2:
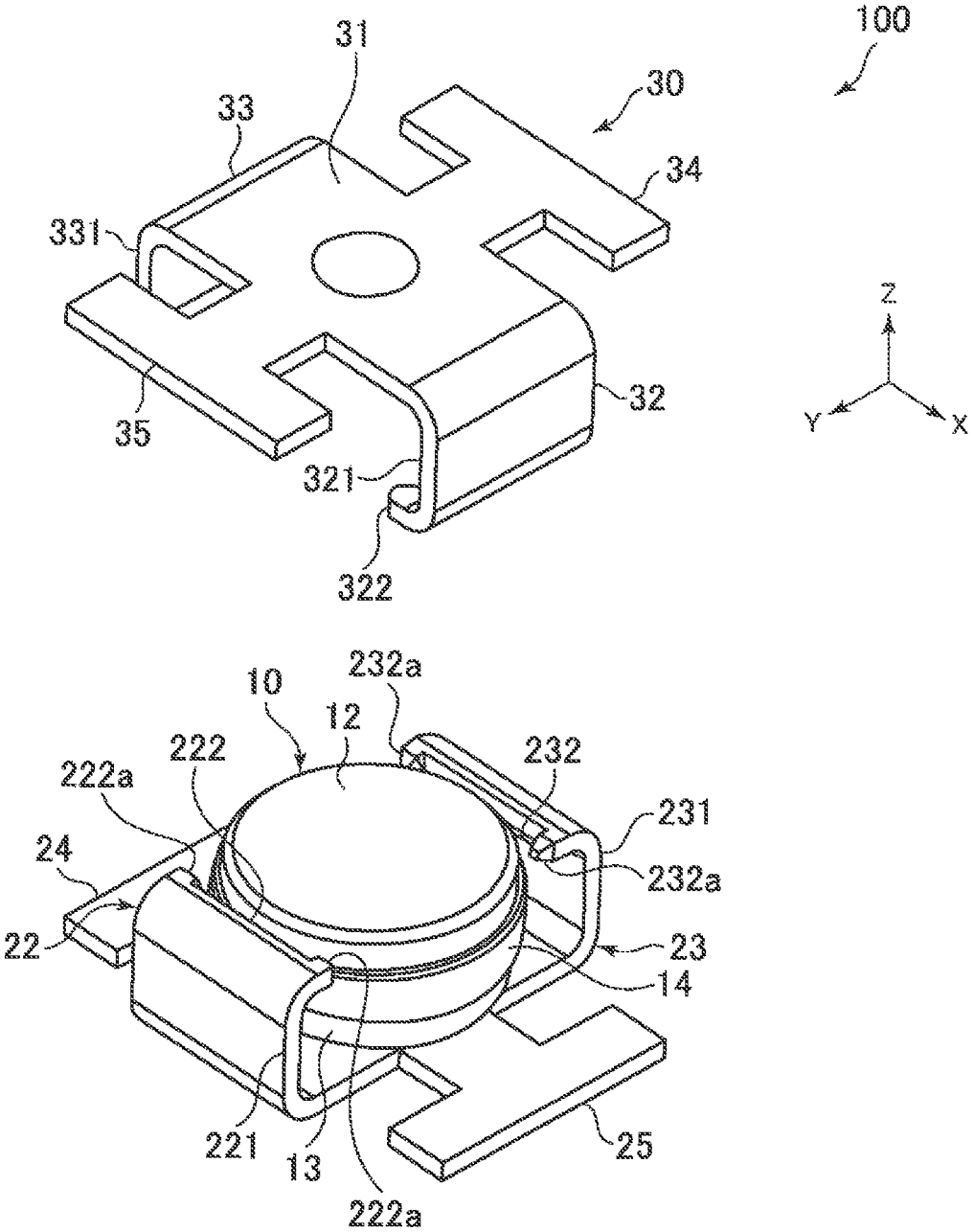
FIG. 2 is a perspective view illustrating the state in which a relay conductor is held by a first connector.
Figure 3:
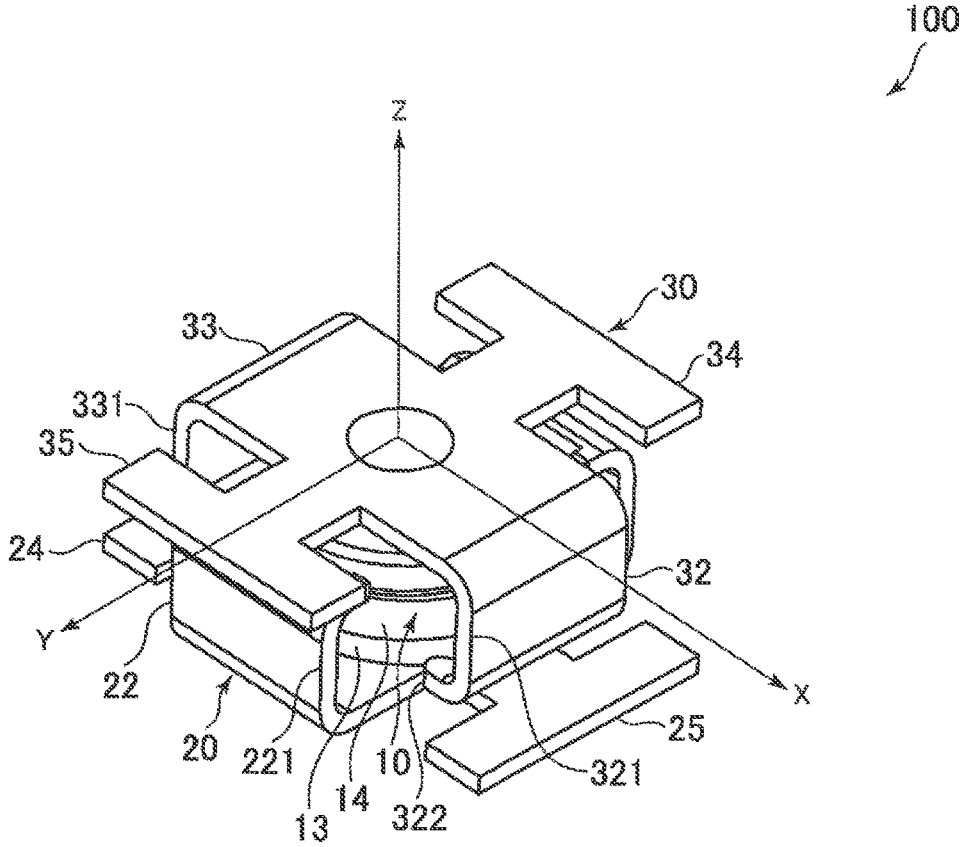
FIG. 3 is a perspective view illustrating the state in which the connector assembly according to the present embodiment is assembled.
Figure 4:
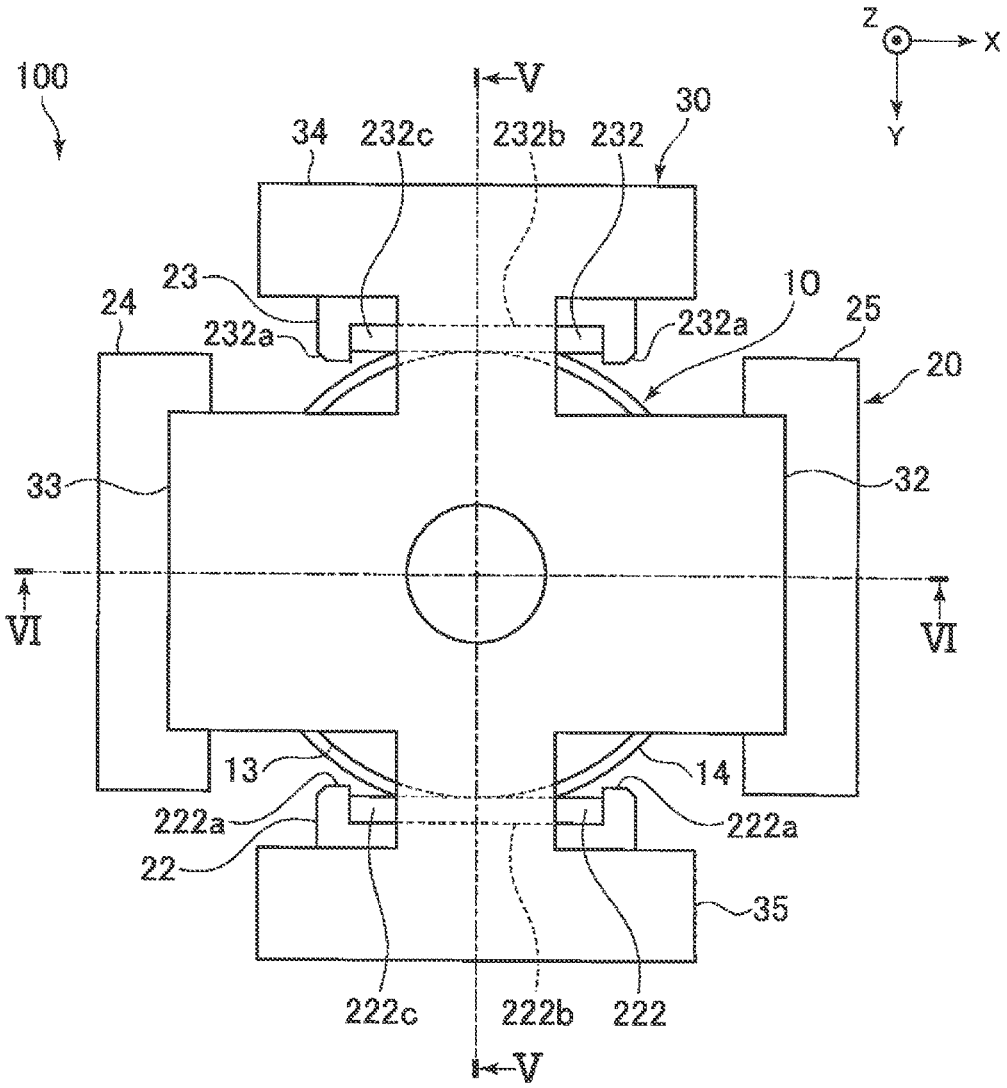
FIG. 4 is a top view of the connector assembly according to the present embodiment.
Figure 5:
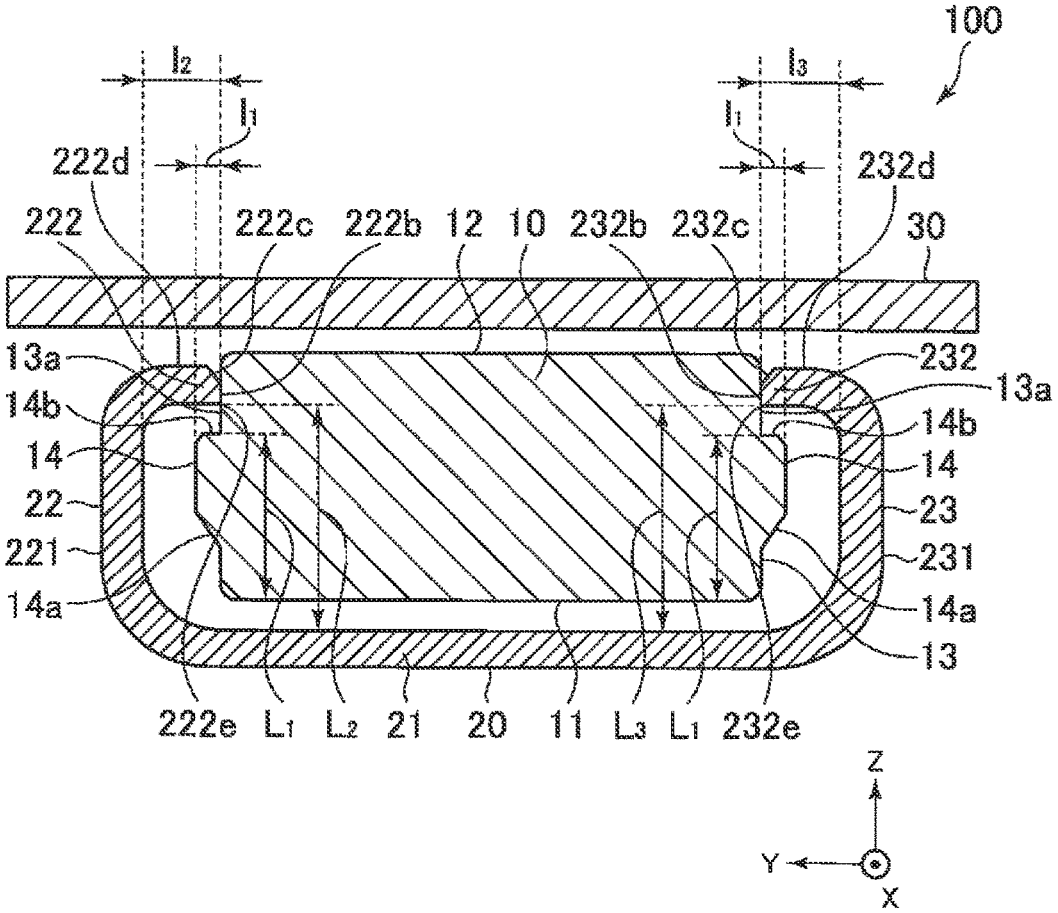
FIG. 5 is a cross sectional view illustrating a cross section taken along line V-V in FIG. 4.
Figure 6:
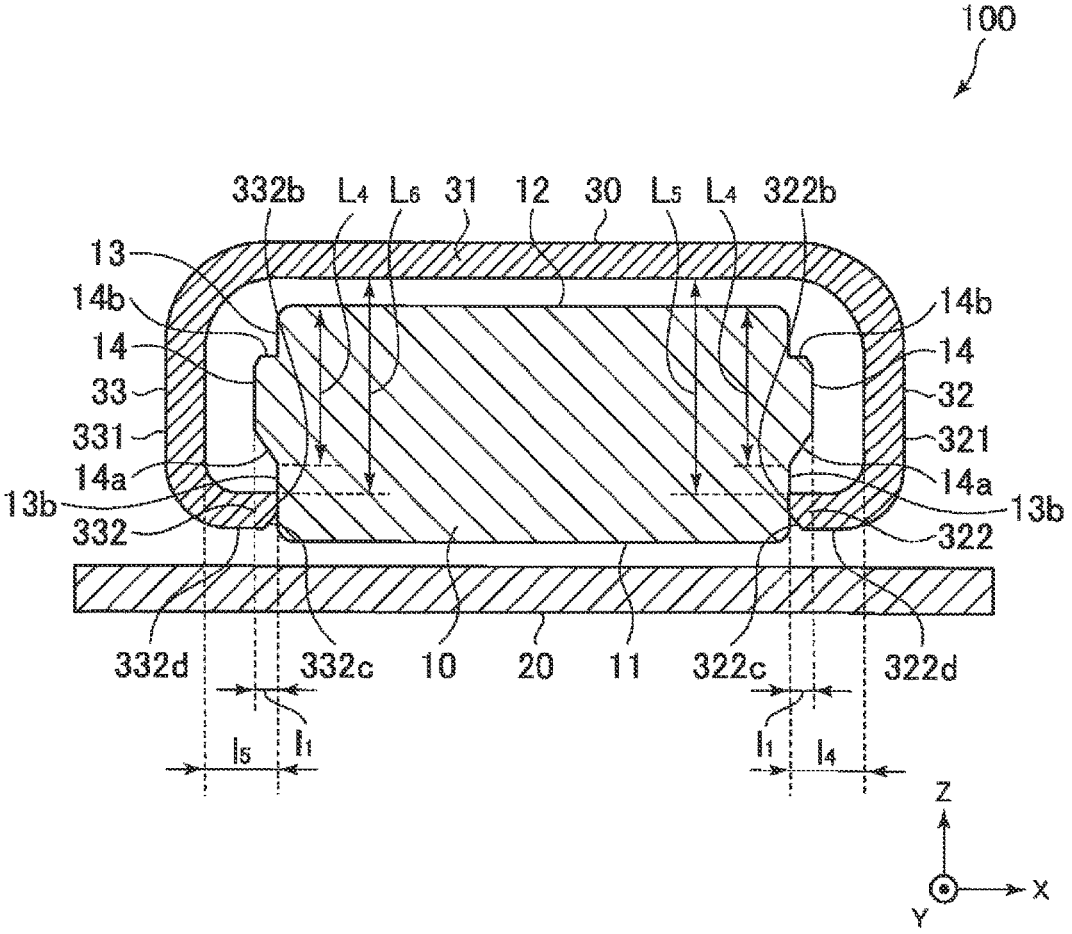
FIG. 6 is a cross sectional view illustrating a cross section taken along line VI-VI in FIG. 4.

Connector assembly 100 according to the embodiment of the present disclosure (hereinafter, referred to as "the present embodiment") will now be described with reference to the drawings. FIG. 1 is an exploded perspective view of a connector assembly according to the present embodiment. FIG. 2 is a perspective view illustrating the state in which a relay conductor is held by a first connector. FIG. 3 is a perspective view illustrating the state in which the relay conductor is further held by a second connector from the state in FIG. 2. That is, FIG. 3 is a perspective view illustrating the state in which the connector assembly is assembled. FIG. 4 is a top view of the connector assembly according to the present embodiment. FIG. 5 is a cross sectional view illustrating a cross section taken along line V-V in FIG. 4. FIG. 6 is a cross sectional view illustrating a cross section taken along line VI-VI in FIG. 4.

In the following description, as illustrated in each drawing, the X-axis direction shall be the relative moving direction of first connector 20 with respect to second connector and the direction that second connector 30 sandwiches relay conductor 10 with a pair of holding parts 322, 332. In addition, the Y-axis direction shall be the relative moving direction of second connector 30 with respect to first connector 20 and the direction that first connector 20 sandwiches relay conductor 10 with a pair of holding parts 222, 232. In addition, the Z-axis direction shall be the center axis direction (vertical direction) of relay conductor 10. In addition, the arrowed direction in the drawings shall be the positive direction of each axis, while the opposite direction of the positive direction shall be the negative direction.

Connector assembly 100 includes relay conductor 10, first connector 20, and second connector 30. Connector assembly 100 electrically connects the circuit board on which first connector 20 is attached with the circuit board on which second connector 30 is attached, via relay conductor 10 that makes contact with a pair of terminals 22, 23 provided on first connector 20 and a pair of connectors 32, 33 provided on second connector 30. In addition, in the present embodiment, first connector 20 and second connector 30 are attachably and detachably provided in the Z-axis direction with respect to relay conductor 10.

A configuration overview of each member provided on connector assembly 100 will be described with reference to mainly FIG. 1.

Relay conductor 10 is preferably a conductive member, for example, metals such as brass and aluminum, or carbon, and the like. Relay conductor 10 is preferably, for example, as illustrated in FIG. 1, a disk shape that includes lower surface 11, upper surface 12, and a side surface 13 for connecting lower surface 11 and upper surface 12. Relay conductor 10 preferably includes retaining part 14 on side surface 13, which protrudes radially outwardly.

First connector 20 preferably includes flat plate part 21, a pair of terminals 22, 23, and a pair of soldering parts 24, 25. Terminal 22 preferably includes elastic portion 221 that bends from plate part 21 as a base part and extends in the generally vertical direction (Z-axis positive direction in the drawing) with respect to flat plate part 21, along with holding part 222 provided at the front end of elastic portion 221. Likewise, terminal 23 preferably includes elastic portion 231 that bends from plate part 21 and extends in the generally vertical direction (Z-axis positive direction in the drawing) with respect to flat plate part 21, along with holding part 232 provided at the front end of elastic portion 231. In addition, first connector 20 preferably includes soldering parts 24, 25 that are soldered to a circuit board (not illustrated) external to connector assembly 100 and extend from flat plate part 21. Although not illustrated in the drawing, the circuit board is preferably provided so as to make face to face contact with the lower surface (the surface opposing the direction in which terminals 22, 23 extend) of flat plate part 21. However, the method for attaching first connector 20 to the circuit board is not limited to soldering and may be any method in which first connector 20 is fixed to the circuit board.

Second connector 30 preferably includes flat plate part 31, a pair of terminals 32, 33, and a pair of soldering parts 34, 35. Terminal 32 preferably includes elastic portion 321 that bends from plate part 31 serving as a base part and extends in the generally vertical direction (Z-axis negative direction in the drawing) with respect to flat plate part 31, along with holding part 322 provided at the front end of elastic portion 322. Likewise, terminal 33 preferably includes elastic portion 331 that bends from plate part 31 and extends in the generally vertical direction (Z-axis negative direction in the drawing) with respect to flat plate part 31, along with holding part 332 provided at the front end of elastic portion 331. In addition, second connector 30 preferably includes soldering parts 34, 35 that are soldered to a circuit board (not illustrated) external to connector assembly 100 and extend from flat plate part 31. Although not illustrated in the drawing, the circuit board is preferably provided so as to make face to face contact with the lower surface (the surface opposing the direction in which terminals 32, 33 extend) of flat plate part 31. However, the method for attaching second connector 30 to the circuit board is not limited to soldering and may be any method in which second connector 30 is fixed to the circuit board.

The present embodiment is disclosed in a manner such that terminals 22, 23 of first connector 20, flat plate part 21 as a base part, and soldering parts 24, 25 are formed integrally from a metal plate. However, it is not limited thereto, and for example, terminals 22, 23 and soldering parts 24, 25 may be integrally formed from a metal plate, flat plate part 21 as a base part may be molded from a resin, and flat plate part 21 may integrally support formed terminals 22, 23 and soldering parts 24, 25. Likewise, with regard to second connector 30, terminals 32, 33 and soldering parts 34, 35 are preferably integrally formed from a metal plate, flat plate part 31 as a base part is preferably molded from a resin, and flat plate part 31 preferably supports integrally formed terminals 32, 33 and soldering parts 34, 35.

Next, a holding structure of first connector 20 that holds relay conductor 10 will be described with reference to mainly FIG. 2, FIG. 4, and FIG. 5.

First connector 20 is arranged on the lower surface 11 side of relay conductor 10. First connector 20 clamps relay conductor 10 with holding part 222 of terminal 22 and holding part 232 of terminal 23. Each of elastic portion 221 of terminal 22 and elastic portion 231 of terminal 23 preferably has elasticity. Because elastic part 221 of terminal 22 and elastic portion 231 of terminal 23 have elasticity, relay conductor 10 is elastically held with holding part 222 of terminal 22 and holding part 232 of terminal 23.

By elastically clamping relay conductor 10 with holding part 222 and holding part 232, it receives an elastic force that acts in the Y-axis negative direction from holding part 222 and receives an elastic force that acts in the Y-axis positive direction from holding part 232. Accordingly, holding part 222 receives an opposing force that acts in the Y-axis positive direction from relay conductor 10, while holding part 232 receives an opposing force that acts in the Y-axis negative direction from relay conductor 10. These opposing forces are canceled out in the Y-axis direction when relay conductor 10 is in a stationary state. Therefore, any load due to first connector 20 elastically holding relay conductor 10 is not applied to the circuit board on which first connector 20 is soldered.

As illustrated in FIG. 4 and FIG. 5, holding part 222 includes clamping piece 222*d* extending toward the holding part 232 side, along with edge 222*b* that is formed at the front end of clamping piece 222*d* and makes contact with relay conductor 10. As illustrated in FIG. 5, assuming that the amount of outward protrusion in the radial direction of retaining part 14 is $l_1$ and the length of clamping piece 222*d* is $l_2$, $l_1$ is preferably made smaller than $l_2$. Making $l_1$ smaller than $l_2$ results in a space between retaining part 14 and elastic portion 221 of terminal 22, preventing retaining part 14 from interfering with elastic portion 221. Likewise, holding part 232 includes clamping piece 232*d* extending toward holding part 222 side, along with edge 232*b* that is formed at the front end of clamping piece 232*d* and makes contact with relay conductor 10. As illustrated in FIG. 5, assuming that the amount of outward protrusion in the radial direction of retaining part 14 is $l_1$ and the length of clamping piece 232*d* is $l_3$, $l_1$ is preferably made smaller than $l_3$. Making $l_1$ smaller than $l_3$ results in a space between retaining part 14 and elastic portion 231 of terminal 23, preventing retaining part 14 from interfering with elastic portion 231.

Edges 222*b*, 232*b* of holding parts 222, 232 that make contact with relay conductor 10 preferably have a linear form extending in the X-axis direction, in a planar view. In addition, edges 222*b*, 232*b* preferably make contact with side surface 13 of relay conductor 10 in a planar shape or in an edge shape in which the plate thickness is reduced by inclined surfaces 222*c*, 232*c*, in a side view. According to such a configuration, relay conductor 10 that is elastically clamped between holding part 222 and holding part 232 is allowed to relatively move in the X-axis direction with respect to first connector 20 along edges 222*b*, 232*b*.

In addition, holding part 222 preferably includes a pair of regulating parts 222*a* that regulate the range of movement of relay conductor 10 in the X-axis direction. As illustrated in FIG. 4, regulating parts 222*a* are preferably protrusions that protrude in the Y-axis negative direction at both ends in the X-axis direction of holding part 222. Likewise, holding part 231 preferably includes a pair of regulating parts 232*a* that regulate the range of movement of relay conductor 10 in the X-axis direction. As illustrated in FIG. 4, regulating parts 232*a* are preferably protrusions that protrude in the Y-axis positive direction at both ends in the X-axis direction of holding part 232. When relay conductor 10 relatively moves in the X-axis direction with respect to first connector 20, part of side surface 13 of relay conductor 10 abuts against regulating part 222*a* and regulating part 232*a*. As a result, relay conductor 10 is suppressed from separating from the first connector in the X-axis direction.

In addition, as illustrated in FIG. 5, relay conductor 10 is preferably elastically clamped between a pair of holding parts 222, 232 such that there is a space in the Z-axis direction between lower surface 11 of relay conductor 10 and flat plate part 21 of first connector 20. Specifically, assuming that the distance in the Z-axis direction between abutting surface 14*b* as described below and lower surface 11 is $L_1$ and the distance between edge 222*b* and flat plate part 21 of first connector 20 is $L_2$, $L_1$ is preferably made smaller than $L_2$. Likewise, assuming that the distance between edge 232*b* and flat plate part 21 of first connector 20 is $L_3$, $L_1$ is preferably made smaller than $L_3$. Making $L_1$ smaller than $L_2$ and $L_1$ smaller than $L_3$ results in a space in the Z-axis direction at least either between lower surface 11 and flat plate part 21 or between edges 222*b*, 232*b* and abutting surface 14*b*. According to such a configuration, relay conductor 10 is allowed to relatively move in the Z-axis direction with respect to first connector 20.

In addition, as illustrated in FIG. 5, relay conductor 10 is preferably elastically clamped between a pair of holding parts 222, 232 on side surface 13*a* above (in the Z-axis positive direction side) retaining part 14. According to such a configuration, when relay conductor 10 relatively moves in the Z-axis positive direction with respect to first connector 20, holding parts 222, 232 are caught on retaining part 14. As a result, relay conductor 10 is suppressed from easily separating from first connector 20. However, as illustrated in FIG. 5, retaining part 14 preferably includes abutting surface 14*b* that, when relay conductor 10 relatively moves in the Z-axis positive direction with respect to first connector 20, makes face to face contact with corner parts 222*e*, 232*e* formed on the side opposite retaining part 14 in clamping pieces 222*d*, 232*d*. As illustrated in FIG. 5, according to a configuration in which, when relay conductor 10 relatively moves in the Z-axis positive direction with respect to first connector 20, corner parts 222*e*, 232*e* fit into a corner that is formed with side surface 13*a* and abutting surface 14*b* and abut abutting surface 14*b*, relay conductor 10 is further suppressed from easily separating from first connector 20.

In addition, in the present embodiment, relay conductor 10 has a disk shape, with the side surface 13*a* thereof having a curved surface with a constant curvature. On the other hand, the region that makes contact with relay conductor 10 in holding parts 222, 232 of first connector 20 is linear edges 222*b*, 232*b*, in a planar view. According to such a configuration, relay conductor 10 is able to rotate about the center axis of relay conductor 10 as the axis of rotation while making side surface 13*a* of relay conductor 10 contact edges 222*b*, 232*b* of holding parts 222, 232. That is, relay conductor 10 is elastically clamped between holding parts 222, 232 of first connector 20 such that making a relative movement in the rotational direction with respect to first connector 20 is allowed.

As described above, in the present embodiment, relay conductor 10 is elastically clamped between holding parts 222, 232 of first connector 20 such that relative movement in the X-axis direction, the Z-axis direction, and the rotational direction with respect to first connector 20 is allowed. As a result, positional displacement in the X-axis direction, the Z-axis direction, or the rotational direction between the circuit board on which first connector 20 is soldered and the circuit board on which second connector 30 is soldered is allowed. In addition, even if positional displacement occurs, no load is placed on the circuit board on which first connector 20 is soldered.

However, relay conductor 10 is not limited to a disk shape. The region of relay conductor 10 with which at least holding part 222 and holding part 232 make contact is preferably a curved surface. More specifically, the region of relay conductor 10 with which at least holding part 222 and holding part 232 contact is preferably a shape that follows a circular arc with the same distance from the center axis of relay conductor 10 in a planar view. According to such a configuration, relay conductor 10 is allowed to relatively move in the rotational direction with respect to first connector 20. In addition, the planar shape of relay conductor 10 is preferably a rectangle shape. That is, relay conductor 10 is preferably a plane surface in which side surface 13 of the relay conductor is parallel to edge 222*a* of holding part 222 and edge 232*a* of holding part 232. According to such a configuration, relay conductor 10 is allowed to relatively move at least in the X-axis direction with respect to first connector 20.

Next, a holding structure of second connector 30 that holds relay conductor 10 will be described with reference to mainly FIG. 3 and FIG. 6.

Second connector 30 is arranged on the upper surface 12 side of relay conductor 10. Second connector 30 clamps relay conductor 10 with holding part 322 of terminal 32 and holding part 332 of terminal 33. Each of elastic portion 321 of terminal 32 and elastic portion 331 of terminal 33 preferably has elasticity. Because elastic part 321 of terminal 32 and elastic portion 331 of terminal 33 have elasticity, relay conductor 10 is elastically held with holding part 322 of terminal 32 and holding part 332 of terminal 33.

By elastically clamping relay conductor 10 with holding part 322 and holding part 332, it receives an elastic force that acts in the X-axis negative direction from holding part 322 and receives an elastic force that acts in the X-axis positive direction from holding part 332. Accordingly, holding part 322 receives an opposing force that acts in the X-axis positive direction from relay conductor 10, while holding part 332 receives an opposing force that acts in the X-axis negative direction from relay conductor 10. These opposing forces are canceled out in the X-axis direction when relay conductor 10 is in a stationary state. Therefore, no load due to second connector 30 elastically holding relay conductor 10 is placed on the circuit board on which second connector 30 is soldered.

As illustrated in FIG. 6, holding part 322 includes clamping piece 322*d* extending toward the holding part 332 side, along with edge 322*b* that is formed at the front end of clamping piece 322*d* and makes contact with relay conductor 10. As illustrated in FIG. 6, assuming that the amount of outward protrusion in the radial direction of retaining part 14 is $l_1$ and the length of clamping piece 322*d* is $l_4$, $l_1$ is preferably made smaller than $l_4$. Making $l_1$ smaller than $l_4$ results in a space between retaining part 14 and elastic portion 321 of terminal 32, preventing retaining part 14 from interfering with elastic portion 321. Likewise, holding part 332 includes clamping piece 332*d* extending toward the holding part 322 side, along with edge 332*b* that is formed at the front end of clamping piece 332*d* and makes contact with relay conductor 10. As illustrated in FIG. 6, assuming that the amount of outward protrusion in the radial direction of retaining part 14 is $l_1$ and the length of clamping piece 332*d* is $l_5$, $l_1$ is preferably made smaller than $l_5$. Making $l_1$ smaller than $l_5$ results in a space between retaining part 14 and elastic portion 331 of terminal 33, preventing retaining part 14 from interfering with elastic portion 331.

Edges 322*b*, 332*b* of holding parts 322, 332 that make contact with relay conductor 10 preferably have a linear form extending in the Y-axis direction, in a planar view. In addition, edges 322*b*, 332*b* preferably make contact with side surface 13 of relay conductor 10 in a planar shape or in an edge shape in which the plate thickness is reduced by inclined surfaces 322*c*, 332*c*, in a side view. According to such a configuration, relay conductor 10 that is elastically clamped between holding part 322 and holding part 332 is allowed to relatively move in the Y-axis direction with respect to second connector 30 along edges 322*b*, 332*b*.

In addition, holding part 322, like abovementioned holding part 222, preferably includes a pair of regulating parts (not illustrated) that regulate the range of movement of relay conductor 10 in the Y-axis direction. The regulating parts of holding part 322 are preferably protrusions that protrude in the X-axis negative direction at both ends in the Y-axis direction of holding part 322. Likewise, holding part 332 preferably includes a pair of regulating parts (not illustrated) that regulate the range of movement of relay conductor 10 in the Y-axis direction. The regulating parts of holding part 332 are preferably protrusions that protrude in the X-axis positive direction at both ends in the Y-axis direction of holding part 332. When relay conductor 10 relatively moves in the Y-axis direction with respect to second connector 30, part of side surface 13 of relay conductor 10 abuts against the regulating parts of holding part 322 and holding part 332. As a result, relay conductor 10 is suppressed from separating from second connector 30 in the Y-axis direction.

In addition, as illustrated in FIG. 6, relay conductor 10 is preferably elastically clamped between a pair of holding parts 322, 332 such that there is a space in the Z-axis direction between upper surface 12 of relay conductor 10 and flat plate part 31 of second connector 30. Specifically, assuming that the distance in the Z-axis direction between the part in inclined surface 14*a* that is nearest to holding part 322 and upper surface 12 is $L_4$ and the distance between edge 322*b* and flat plate part 31 of second connector 30 is $L_5$, $L_4$ is preferably made smaller than $L_5$. Likewise, assuming that the distance between edge 332*b* and flat plate part 31 of second connector 30 is $L_6$, $L_4$ is preferably made smaller than $L_6$. Making $L_4$ smaller than $L_5$ and $L_4$ smaller than $L_6$ results in a space in the Z-axis direction at least either between upper surface 12 and flat plate part 31 or between edges 322*b*, 332*b* and the part in inclined surface 14*a* that is nearest holding part 322, 332. According to such a configuration, relay conductor 10 is allowed to relatively move in the Z-axis direction with respect to second connector 30.

In addition, as illustrated in FIG. 6, relay conductor 10 is preferably elastically clamped between a pair of holding parts 322, 332 on side surface 13*b* below (in the Z-axis negative direction side) retaining part 14. According to such a configuration, when relay conductor 10 relatively moves in the Z-axis negative direction with respect to second connector 30, holding parts 322, 332 are caught on retaining part 14. As a result, relay conductor 10 is suppressed from easily separating from second connector 30.

In addition, in the present embodiment, relay conductor 10 has a disk shape, with the side surface 13*b* thereof having a curved surface with a constant curvature. On the other hand, the region that makes contact with relay conductor 10 in holding parts 322, 332 of second connector 30 is linear edges 322*b*, 332*b*, in a planar view. According to such a configuration, relay conductor 10 is able to rotate about the center axis of relay conductor 10 as the axis of rotation while making side surface 13*b* of relay conductor 10 contact edges 322*b*, 332*b* of holding parts 322, 332. That is, relay conductor 10 is elastically clamped between holding parts 322, 332 of second connector 30 such that relative movement in the rotational direction with respect to second connector 30 is allowed.

Here, when the abovementioned side surface 13*a* and side surface 13*b* have a curved surface with a constant curvature, that is, they are formed with a predetermined radius, the width between the pair of edges can be different in first connector 20 and second connector 30 by making the radius of side surface 13*a* and the radius of side surface 13*b* different. Accordingly, the size of the connector can be changed depending on the location where first connector 20 and second connector 30 are installed.

As described above, in the present embodiment, relay conductor 10 is elastically clamped between holding parts 322, 332 of second connector 30 such that relative movement in the Y-axis direction, the Z-axis direction, and the rotational direction with respect to second connector 30 is allowed. As a result, positional displacement in the Y-axis direction, the Z-axis direction, or the rotational direction between the circuit board on which first connector 20 is soldered and the circuit board on which second connector 30 is soldered is allowed. In addition, even if positional displacement occurs, no load is placed on the circuit board on which second connector 30 is soldered.

However, relay conductor 10 is not limited to a disk shape. The region of relay conductor 10 with which at least holding part 322 and holding part 332 make contact may be a curved surface. More specifically, the region of relay conductor 10 with which at least holding part 322 and holding part 332 contact is preferably a shape that follows a circular arc with the same distance from the center axis of relay conductor 10 in a planar view. According to such a configuration, relay conductor 10 is allowed to relatively move in the rotational direction with respect to second connector 30. In addition, the planar shape of relay conductor 10 may be a rectangle shape. That is, relay conductor 10 is preferably a plane surface in which side surface 13 of the relay conductor is parallel to edge 322*b* of holding part 322 and edge 332*b* of holding part 332. According to such a configuration, the relay conductor is allowed to relatively move at least in the Y-axis direction with respect to second connector 30.

Next, the attaching structure of first connector 20 to relay conductor 10 is described with reference to mainly FIG. 1 and FIG. 5. By adopting the structure described below, first connector 20 can easily be attached to relay conductor 10.

As illustrated in FIG. 5, inclined surface 222*c* is preferably provided on holding part 222 of first connector 20, while inclined surface 232*c* is preferably provided on holding part 232 of first connector 20. Inclined surface 222*c*, 232*c* is preferably provided on the opposite side of retaining part 14 of relay conductor 10 in the Z-axis direction, in the state in which first connector 20 holds relay conductor 10.

In addition, as illustrated in FIG. 5, inclined surface 14*a* is preferably provided on retaining part 14 of relay conductor 10. Inclined surface 14*a* is preferably provided on the opposite side of holding parts 222, 232 of first connector 20 in the Z-axis direction, in the state in which first connector 20 holds relay conductor 10.

Relay conductor 10 is fitted into first connector 20 in the Z-axis direction such that relay conductor 10 is sandwiched between holding parts 222, 232 of first connector 20 from the state in which relay conductor 10 and first connector 20 illustrated in FIG. 1 are spaced apart from each other. At this time, first, inclined surface 14*a* of relay conductor 10 makes contact with inclined surfaces 222*c*, 232*c* of first connector 20. Then, once holding parts 222, 232 are pushed with relay conductor 10, elastic part 221 of terminal 22 elastically deforms in the Y-axis positive direction, while elastic part 231 of terminal 23 elastically deforms in the Y-axis negative direction. In addition, inclined surface 14*a* of relay conductor 10 and inclined surfaces 222*c*, 232*c* of first connector 20 slide, and thereafter, holding part 222 and holding part 232 climb over retaining part 14, thereby elastically holding side surface 13*a* above retaining part 14 of relay conductor 10. Accordingly, because when first connector 20 is attached to relay conductor 10, inclined surface 14*a* of relay conductor 10 and inclined surfaces 222*c*, 232*c* of first connector 20 slide, holding part 222 and holding part 232 are not caught on retaining part 14, thereby allowing first connector 20 to be easily attached to relay conductor 10.

Next, the attaching and detaching structure of second connector 30 to relay conductor 10 will be described with reference to mainly FIG. 1, FIG. 3, and FIG. 6. By adopting the structure described below, second connector 30 can easily be attached to and detached from relay conductor 10.

As illustrated in FIG. 6, inclined surface 322*c* is preferably provided on holding part 322 of second connector 30, while inclined surface 332*c* is preferably provided on holding part 332 of second connector 30. Inclined surface 322*c*, 332*c* is preferably provided on the opposite side of retaining part 14 of relay conductor 10 in the Z-axis direction, in the state in which second connector 30 holds relay conductor 10. In addition, as described above, inclined surface 14*a* is preferably provided on retaining part 14 of relay conductor 10.

Relay conductor 10 is fitted into second connector 30 in the Z-axis direction such that relay conductor 10 is sandwiched between holding parts 322, 332 of second connector 30 from the state in which relay conductor 10 and second connector 30 illustrated in FIG. 1 are spaced apart from each other. At this time, first, abutting surface 14*b* of retaining part 14 of relay conductor 10 makes contact with inclined surfaces 322*c*, 332*c* of second connector 30. Then, once holding parts 322, 332 are pushed with relay conductor 10, elastic part 321 of terminal 32 elastically deforms in the X-axis positive direction, while elastic part 331 of terminal 33 elastically deforms in the X-axis negative direction. In addition, inclined surfaces 322*c*, 332*c* of second connector 30 slide with respect to retaining part 14 of relay conductor 10, and thereafter, holding part 322 and holding part 332 climb over retaining part 14, thereby elastically holding side surface 13*b* below retaining part 14 of relay conductor 10. Accordingly, because when second connector 30 is attached to relay conductor 10, inclined surfaces 322*c*, 332*c* of second connector 30 slide with respect to retaining part 14 of relay conductor 10, holding part 322 and holding part 332 are not caught on retaining part 14, thereby allowing second connector 30 to be easily attached to relay conductor 10.

Second connector 30 is detached from relay conductor 10 by pulling second connector 30 in the Z-axis positive direction, from the state in which relay conductor 10 is fitted into second connector 30 as illustrated in FIG. 3. At this time, first, inclined surface 14*a* of relay conductor 10 makes contact with holding parts 322, 332 of second connector 30. Then, once holding parts 322, 332 are pushed with relay conductor 10, elastic part 321 of terminal 32 elastically deforms in the X-axis positive direction, while elastic part 331 of terminal 33 elastically deforms in the X-axis negative direction. In addition, inclined surface 14*a* of relay conductor 10 and holding parts 322, 332 of second connector 30 slide, and thereafter, holding part 322 and holding part 332 clime over retaining part 14, thereby causing second connector 30 to detach from relay conductor 10. Accordingly, because when second connector 30 is detached from relay conductor 10, inclined surface 14*a* of relay conductor 10 slides with respect to holding parts 322, 332 of second connector 30, holding part 322 and holding part 332 are not caught on retaining part 14, thereby allowing second connector 30 to be easily detached from relay conductor 10. However, the inclined angle of inclined surface 14*a* is not limited to those illustrated in the drawings and may be set appropriately according to applications and the like. If the inclined angle of inclined surface 14*a* is gentler, second connector 30 can be more easily detached from relay conductor 10, while if the inclined angle of inclined surface 14*a* is steeper, second connector 30 can be held more stably second connector 30 with respect to relay conductor 10.

However, as described above, in the present embodiment, as for retaining part 14 of relay conductor 10, abutting surface 14*b* is provided on holding parts 222, 232 of the first connector 20 side and retaining part 14*a* is provided on holding parts 322, 332 of the second connector 30 side. For this reason, because the electrical connection between the circuit board on which first connector 20 is soldered and the circuit board on which second connector 30 is soldered is disconnected, when either one of the circuit boards is pulled in a direction to separate it from the other circuit board, second connector 30 is detached from relay conductor 10, causing first connector 20 to hold relay conductor 10. That is, when the electrical connection between the circuit board on which first connector 20 is soldered and the circuit board on which second connector 30 is soldered is disconnected, relay conductor 10 remains on the first connector 20 side. However, first connector 20 is not limited to the configuration in which the first connector is attachable to and detachable from relay conductor 10. That is, it is configured such that first connector 20 always holds relay conductor 10 and is configured such that only second connector 30 is attachable to and detachable from relay conductor 10.

In the present embodiment, first connector 20 and second connector 30 have the same structure. As a result, first connector 20 and second connector 30 can be manufactured by a similar process, allowing connector assembly 100 to be efficiently produced.

In addition, as illustrated in each drawing, retaining part 14 is preferably provided continuously over the entire outer perimeter of relay conductor 10. Accordingly, because holding parts 222, 232 of first connector 20 and holding part 322, 332 of second connector 30 are caught on retaining part 14 even if first connector 20 and second connector 30 are at any position in the rotational direction, first connector 20 and second connector 30 are suppressed from easily separating from relay conductor 10.

As described above, as for connector assembly 100 according to the present embodiment, positional displacement between the circuit board on which first connector 20 is soldered and the circuit board on which second connector 30 is soldered is allowed in any of the X-axis direction, the Y-axis direction, the Z-axis direction, and the rotational direction, with no load placed on each circuit board even if positional displacement occurs. This is because first connector 20 relatively moves in the X-axis direction with respect to relay conductor 10 even if the circuit board on which first connector 20 is soldered and the circuit board on which second connector 30 is soldered are positionally displaced in the X-axis direction. In addition, this is because second connector 30 relatively moves in the Y-axis direction with respect to relay conductor 10 even if the circuit board on which first connector 20 is soldered and the circuit board on which second connector 30 is soldered are positionally displaced in the Y-axis direction. In addition, this is because at least one of first connector 20 and second connector 30 relatively moves in the Z-axis direction with respect to relay conductor 10 even if the circuit board on which first connector 20 is soldered and the circuit board on which second connector 30 is soldered are positionally displaced in the Z-axis direction. In addition, this is because at least one of first connector 20 and second connector 30 relatively moves in the rotational direction with respect to relay conductor 10 even if the circuit board on which first connector 20 is soldered and the circuit board on which second connector 30 is soldered are positionally displaced in the rotational direction.

However, the circuit board on which first connector 20 is soldered and the circuit board on which second connector 30 is soldered are preferably configured such that generally the entire region of these circuit boards are provided so as to be opposite each other, or preferably configured such that part of these circuit boards are provided so as to be opposite each other.

In addition, in the drawings, a configuration is illustrated in which soldering parts 24, 25 of first connector 20 and soldering parts 34, 35 of second connector 30 are arranged parallel to each other in the state in which first connector 20 and second connector 30 hold relay conductor 10. According to such a configuration, the circuit board on which soldering parts 24, 25 are soldered and the circuit board on which soldering parts 34, 35 are soldered can be electrically connected via connector assembly 100 in the state of being arranged parallel to each other. However, it is not limited to such a configuration and, for example, may be formed such that soldering part 24 of first connector 20 is bent from flat plate part 21 and extends in the Z-axis negative direction. According to such a configuration, the circuit board on which soldering part 24 is soldered and the circuit board on which soldering parts 34, 35 are soldered can be electrically connected via connector assembly 100 in the state of being arranged perpendicular to each other.

The disclosure according to the present specification is only one example of a connector assembly, with any appropriate change that maintains the spirit of the present disclosure and can easily be arrived at by a person skilled in the art also being within the scope of the present disclosure.

The invention claimed is:

1. A connector assembly comprising:

a first connector;

a second connector opposing the first connector; and a relay conductor that is held by the first connector and the second connector and allows conduction between the first and second connector, wherein the relay conductor includes a first surface opposing the first connector, a second surface opposing the second connector, and a side surface for connecting the first surface and the second surface, wherein the first connector includes a pair of terminals that clamp the relay conductor such that movement of the relay conductor in a first direction, which is a relative moving direction with respect to the second connector, is allowed, the pair of terminals of the first connector includes holding parts that are supported by a base part and on which edges are respectively formed along the first direction extending through between the first surface and the second surface of the relay conductor, and the edges conductively clamp the side surface of the relay conductor so as to allow conduction with the relay conductor, and wherein the second connector includes a pair of terminal that clamp the relay conductor such that movement of the relay conductor in a second direction, which is a relative moving direction with respect to the first connector and intersects the first direction, is allowed, the pair of terminals of the second connector includes holding parts that are supported by a base part and on which edges are respectively formed along the second direction extending through between the first surface and the second surface of the relay conductor, and the edges conductively clamp the side surface of the relay conductor so as to allow conduction with the relay conductor.

2. The connector assembly according to claim 1, wherein each of the holding parts provided on the pair of terminals of the first connector includes clamping pieces that extend to the other terminal, with the edge formed on this clamping piece; and each of the holding part provided on the pair of terminals of the second connector has clamping pieces extending to the other terminal, with the edge formed on this clamping piece.

3. The connector assembly according to claim 1, wherein a gap is provided at least either between the first surface of the relay conductor and the base part of the first connector or between the second surface of the relay conductor and the base part of the second connector.

4. The connector assembly according to claim 1, wherein the relay conductor has a disk shape and the region that is clamped between and makes contact with a pair of the edges in the side surface has a continuous, identical radius curved surface.

5. The connector assembly according to claim 1, wherein the holding parts of the first connector include a pair of regulating parts for regulating the movable range of the relay conductor in the first direction.

6. The connector assembly according to claim 1, wherein the holding parts of the second connector include a pair of regulating parts for regulating the movable range of the relay conductor in the second direction.

7. The connector assembly according to claim 1, wherein the relay conductor includes a retaining part that protrudes from the side surface, the side surface that is nearer the second connector side than the retaining part of the relay conductor is held on the holding parts of the first connector, and the side surface that is nearer the first connector side than the retaining part of the relay conductor is held on the holding parts of the second connector.

8. The connector assembly according to claim 7, wherein the retaining part includes inclined surfaces on which, when the first connector and the second connector are spaced apart from each other, they slide to the edge of the second connector following the side surface of the first connector, along with an abutting surface that protrudes from the side surface on the second connector side and on which the clamping piece of the first connector is locked.

9. The connector assembly according to claim 7, wherein at least one of the holding parts of the first connector and the holding parts of the second connector has inclined surfaces on which, when it is attached to the relay conductor, it slides to the retaining part.

10. A connector assembly comprising:

a relay conductor having first and second surfaces and a side surface that connects the first and second surfaces;

a first connector having a first plate part and first and second terminals, the first terminal extending from a first side of the first plate part, the second terminal extending from a second side of the first plate part, the first plate part being positioned to oppose the first surface of the relay conductor, the first and second terminals being configured to contact the side surface of the relay conductor so as to restrict movement of the relay conductor in a first direction, but to allow movement of the relay conductor in a second direction; and a second connector having a second plate part and third and fourth terminals, the third terminal extending from a first side of the second plate part, the fourth terminal extending from a second side of the second plate part, the second plate part being positioned to oppose the second surface of the relay conductor, the third and fourth terminals being configured to contact the side surface of the relay conductor so as to restrict movement of the relay conductor in the second direction, but to allow movement of the relay conductor in the first movement, wherein, when the relay conductor is contacted by each of the first and second connectors, the relay conductor allows conduction between the first and second connectors.

11. The connector assembly as defined in claim 10, wherein the first and second sides of the first plate part are parallel to one another, wherein the first and second sides of the second plate part are parallel to one another, and wherein the first and second sides of the first plate part are perpendicular to the first and second sides of the second plate part.

12. The connector assembly as defined in claim 10, wherein the first surface of the relay conductor is parallel to the first plate part of the first connector, wherein, upon movement of the relay conductor in the second direction, the first surface of the relay conductor and the first plate part of the first connector remain in parallel relation.

13. The connector assembly as defined in claim 12, wherein the second surface of the relay conductor is parallel to the second plate part of the second connector, wherein, upon movement of the relay conductor in the first direction, the second surface of the relay conductor and the second plate part of the second connector remain in parallel relation.

14. The connector assembly as defined in claim 10, wherein the first connector has first and second soldering parts, the first soldering part extending from a third side of the first plate part, the second soldering part extending from a fourth side of the first plate part, wherein the third and fourth sides of the first plate part are parallel to one another, and wherein the first and second sides of the first plate part are perpendicular to the third and fourth sides of the first plate part.

15. The connector assembly as defined in claim 14, wherein the second connector has third and fourth soldering parts, the third soldering part extending from a third side of the second plate part, the fourth soldering part extending from a fourth side of the second plate part, wherein the third and fourth sides of the second plate part are parallel to one another, and wherein the first and second sides of the second plate part are perpendicular to the third and fourth sides of the second plate part.

16. A connector assembly comprising:

a relay conductor having an upper surface, a lower surface, and a side surface that connects the upper and lower surfaces, the side surface having an upper portion provided proximate to the upper surface and a lower portion provide proximate to the lower surface;

an upper connector having first and second terminals, the first and second terminals being configured to contact the lower portion of the side surface of the relay conductor so as to restrict movement of the relay conductor in a first direction, but to allow movement of the relay conductor in a second direction; and a lower connector having third and fourth terminals, the third and fourth terminals being configured to contact the upper portion of the side surface of the relay conductor so as to restrict movement of the relay conductor in the second direction, but to allow movement of the relay conductor in the first movement, wherein, when the relay conductor is contacted by each of the first and second connectors, the relay conductor allows conduction between the first and second connectors.

* * * * *